US005377701A

United States Patent [19]

Fang

[11] Patent Number: 5,377,701

[45] Date of Patent: Jan. 3, 1995

[54] SUCKING MASSAGE DEVICE FOR BEAUTY TREATMENT

[76] Inventor: Cunyun Fang, No. 2, Meishan Road, Hefei, Anhui Province, China

[21] Appl. No.: 36,205

[22] Filed: Mar. 23, 1993

[30] Foreign Application Priority Data

Mar. 23, 1992 [CN] China ..... 92101865.7
Feb. 25, 1993 [CN] China ..... 93101980.X

[51] Int. Cl.[6] ..... A45D 70/08

[52] U.S. Cl. ..... 132/271; 132/212; 601/6

[58] Field of Search ..... 132/271, 212; 601/6, 601/8, 9, 10, 12, 13, 14

[56] References Cited

U.S. PATENT DOCUMENTS 1,882,040 10/1932 Roehm ..... 128/38
1,919,571 7/1933 Pinkston ..... 128/38
2,017,284 10/1935 Lembright et al. ..... 128/38
2,249,500 7/1941 Shirley et al. ..... 128/38
2,571,398 10/1951 Wheeler ..... 128/40
3,818,904 6/1974 Kawada ..... 128/40
3,906,940 9/1975 Kawada ..... 128/40
5,003,966 4/1991 Saka et al. ..... 128/39

FOREIGN PATENT DOCUMENTS 60-246756 12/1985 Japan .

*Primary Examiner*—Gene Mancene
*Assistant Examiner*—Frank A. LaViola
*Attorney, Agent, or Firm*—Roylance, Abrams, Berdo & Goodman

[57] ABSTRACT

A sucking massage device for beauty treatment consists of a sucking lip, a negative pressure generator, a driving controller and a case. The sucking lip has a shape of a gyrorotor formed by two thin wall hooks, which are arranged symmetrically with their points facing, gyrating with respect to the central longitudinal axis. The sucking lip can be made of soft material with elasticity, for example, rubber or soft synthetic material with elasticity. The device can give a comfortable feeling and a satisfied effect to users.

15 Claims, 6 Drawing Sheets

SUCKING MASSAGE DEVICE FOR BEAUTY TREATMENT

INTRODUCTION

The present invention relates to a hygienic device, and particularly to a hygienic device for skin, and more particularly to a sucking massage device for beauty treatment which can remove facial wrinkles and beautify the facial skin. The device provided by the present invention has both a sucking lip with the cross sections of series concentric circles and the vertical section of gyrorotor of two facing hooks arranged symmetrically, and a diaphragm detachedly connected with the drawing member, which brings about a smoothly comfortable sucking massage to the skin and remarkable effect of removing facial wrinkles.

BACKGROUND

There are various sucking massage devices for skin beauty treatment, Japanese Patent No. 60-246756 discloses such a device, in which the sucking lip has a shape of general cylinder and contacts with the skin along a circular area and a piston is used to bring about the sucking effect. This kind of device has a disadvantage of a constant sucking force which generates great gradient of pressure between the outside and inside of the contact portion of the sucking lip which contacts with the skin, which leads to an uncomfortable feeling, even results in extravasated blood of the skin. Moreover, this device has other disadvantages of both the uncontrolled value of the sucking force, which can not be adapted in the sucking massage at difference parts (for example, eyes), and the relative sliding movement of the sucking lip to the skin, which results from the deformation of the sucking lip and damages the skin.

SUMMARY OF THE INVENTION

Accordingly, the object of the invention is to provided a sucking massage device for beauty treatment, the sucking force of which can be adjusted to adapt the requirement of sucking massages at different parts of skin and be limited within a certain range to prevent damage of the skin. The sucking lip of the sucking massage device for beauty treatment may adjust the area of the skin sucked without relative sliding movement in such a manner that the sucking force is changed automatically and smoothly within a certain range.

To realize above object, according to the present invention, the sucking massage device for beauty treatment provided consists of a sucking lip, a negative pressure generator, a driving controller and a case. The cross sections of the sucking lip are series concentric circles and the cross section has a shape of two thin wall hooks symmetrically arranged with their points facing parallel of the central axis to the device. That is, the shape of the sucking lip is a gyrorotor formed by two thin wall hooks, which are arranged as above, gyrating with respect to the central longitudinal axis. The sucking is open at its upper end, and has a concave bottom with a center hole formed at the center thereof.

The sucking lip may be made of soft organic synthetic material with elasticity, such as rubber or soft organic material.

The sucking lip can clamp on the case or be fastened on the case by a threaded sleeve. The securing position of the sucking lip to the case can be moved downwardly and upwardly along the case to change the volume of the chamber, where a negative pressure is formed, to follow the requirement of sucking massages at different parts. The sucking lip is detachable from the case for cleaning and replacing various other lips according to the requirement of the sucking massages at different parts.

The negative pressure generator may be a diaphragm actuated by the driving controller, or be a cylinder with a piston therein actuated by the driving controller.

The diaphragm may be made of soft elastic material, such as rubber or soft organic synthetic material with elasticity, and has a shape similar to that of the sucking lip, that is, its cross sections are series concentric circles and its vertical section has a shape of two thin wall hooks arranged symmetrically with their points facing parallel to the central axis of the device, in particular, the diaphragm has a shape of a gyrorotor formed by two thin wall hooks, which is arranged as above, gyrating with respect to its own central longitudinal axis. The diaphragm is also open at the upper end, and has a concave bottom with a center hole formed at the center thereof. In the sucking lip is arranged the diaphragm with its flange at its upper open end tightly joining to the case. The diaphragm is connected at its center hole with the connection unit of the driving controller.

The driving controller includes a motor with a speed reducer, a switch and the connection unit. To be a replacement, it may consist of an electromagnetic means, a controlling circuit, a switch and the connection unit.

Under the action of the driving controller, the drawing member of the connection unit drives the center hole portion of the diaphragm to move downwardly and upwardly so as to bring about a reciprocating movement of the center hole portion of the diaphragm, whereby a change of volume of the negative pressure chamber formed by the diaphragm, the sucking lip and the skin sucked is achieved. As a result, the negative pressure required in sucking massage is generated. Because of the specific shape of the sucking lip, with the increase of the negative pressure, the sucking lip deforms and contacts the skin with its more radially outward section, thereby increasing the area of the skin sucked. Moreover, when the negative pressure chamber tends to be expanded resulted from the further lift of center hole portion of the diaphragm, the longitudinal compression strain of the sucking lip, resulted from the pressure difference between the inner and outer sides of the contact section, gradually offsets the expanding tendency of the volume. Therefore, the change of negative pressure chamber, or the negative pressure, smoothly, not suddenly, goes on within a limited range, thereby preventing both relatively sliding movement of the sucking lip to the skin and sudden change of the sucking force so that a general constant maximum sucking force is defined. That the circular area of the skin sucked by the sucking lip have a greater width than that of prior art and that the sucking force is changed smoothly bring about a comfortable sucking massage without damaging the skin. Moreover, the selection of different sucking lips and the selection of the snapping position of the sucking lip on the case can be used to change the volume of the negative pressure chamber to follow the requirement of sucking massage at the different parts, such as eyes or cheek.

The sucking effect of the sucking lip of the present invention can suck out remnants of cosmetics on the face, secretions from pores and greasy dirts, has the pores be more clear and thinner, and improves the sucked skin to be delicate, clean and bright, as well as prevents and helpfully treats acne. Also the sucking effect can improve the blood circulation and skin nutrition, and have the skin bright and ruddy. The sucking effect can also be used to train the muscle under the skin to rich the facial expression, and remove or lighten the wrinkles on the face. The effect is also helpful to remove fatigue and re-energies the people, and particularly to relax the eyes after reading for a long time to protect the sight. Additionally, the long-term use of the device provided by the prevent invention can prevent temporary near sight. The sucking massage device for beauty treatment has an advantage of lower cost and is suitable to be used at home.

Further objects and the advantages of the invention will appear from the following description taken together with the accompanying drawings

DETAILED DESCRIPTION OF THE PREFERRED EMBODIMENTS

Figure 1:
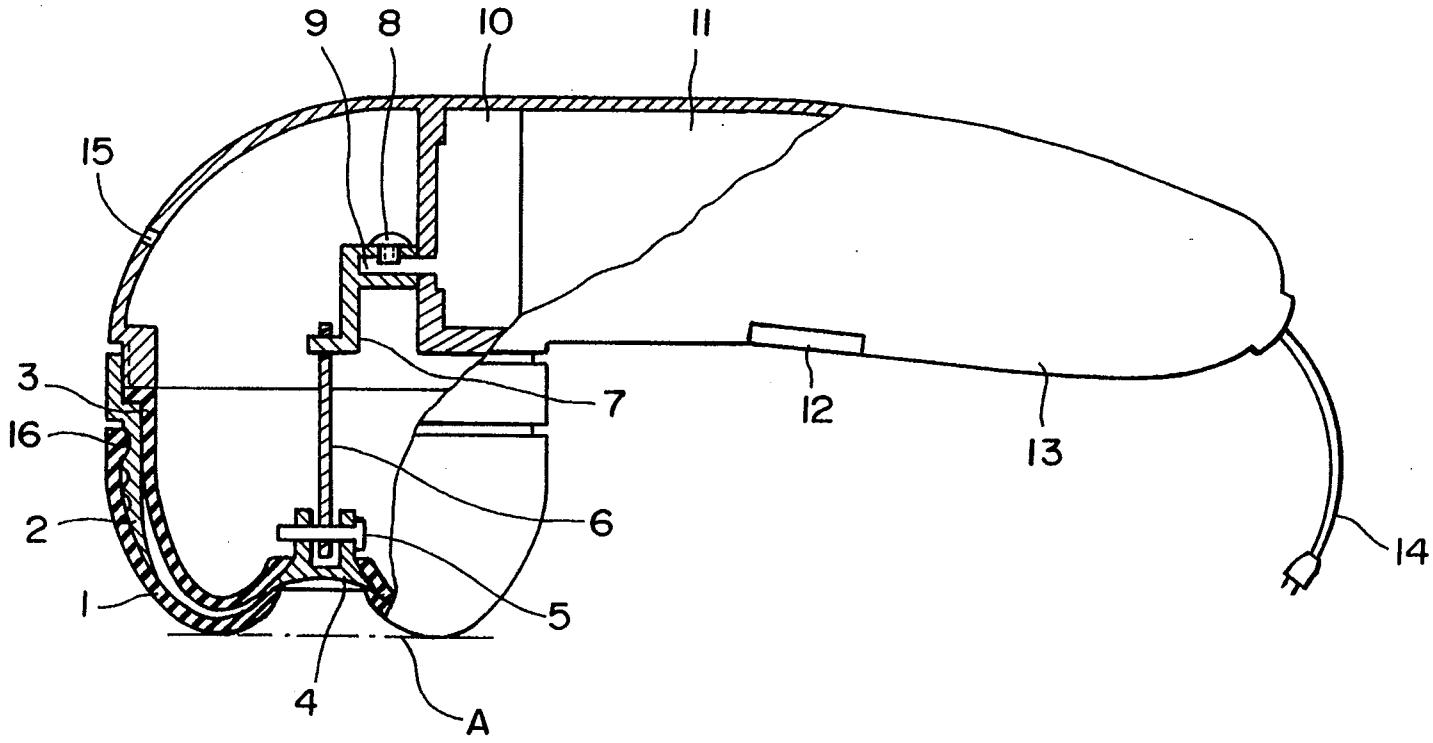
FIG. 1 is a partially sectional view of the first embodiment according to the invention.

The reference is first made to FIG. 1 showing the first embodiment of the invention. A diaphragm 3 is tightly fastened to a case 13 by means of a threaded snapping member 2 having a circular shape and being fitted with the case 13. Three circular grooves are formed in the outer wall of lower portion of the snapping member 2. A sucking lip 1 is open at the top end, and a snapping ring 16 is formed in the inner wall of the open end. The ring 16 can tightly fit with one of the grooves of the snapping member 2 to ensure a tight connection of the sucking lip 1 and the snapping member 2 when the member 2 is received in the lip 1.

A connection unit includes a drawing member 4, a pin 5 and a elongated connection rod 6, The drawing member 4 have a general shape of an inverted flat head wood screw. The member 4 is located in the center hole of the diaphragm 3 with the cone surface of one side of the head tightly adjoining against the center hole portion of the diaphragm. At the other side of the head of the member 4 is formed a concave bottom. A vertical groove is formed in the body of the drawing member 4. A through hole is formed transversely through the body of the member 4. The elongated rod 6 has holes respectively at its two longitudinal ends. The pin 5 extends through the holes of the member 4 and the rod 6, and has the member 4 and the rod 6 pivoted thereon. A crank 7 has an end pivotally inserted in the hole at the other end of the elongated rod 6. At that end of the crank 7 is provided restricting springs at the same time (not shown) to prevent failure of the connection. The output shaft 9 of a speed reducer is received in the sleeve formed at the other end of the crank 7. The sleeve has a threaded transverse hole through its body and the output shaft 9 has a longitudinal key way. A screw 8 fixedly connects the sleeve and the shaft 9 by means of fitting with both the threaded hole and the key groove.

A driving controller includes the speed reducer 10, a motor 11 and a switch 12, which are arranged in the case 13. The electrical power wire 14 electrically connects with the motor 11 through the switch 12. A air orifice 15 is formed in the wall of the case 13 for flow of air.

Before in use, the particular circular groove in the snapping member 2 is selected according to the requirement of sucking massages at different parts of the human body to fit the ring 16 to form a proper negative pressure chamber with required volume.

When in use, the motor 11 is electrically energized to drive the speed reducer 10. Then the output shaft 9 drives the crank 7, elongated rod 6 and the drawing member 4, so as to obtain a reciprocating movement of the center hole portion of the diaphragm 3.

When the drawing member 4 is drawn upwardly, the diaphragm 3 is deformed. Because the center hole portion of the diaphragm 3 is still joined tightly with the drawing member 4, the chamber formed by the diaphragm 3, the sucking lip 1 and skin A is expanded and a negative pressure is formed therein to suck the skin A.

When the drawing member 4 moves downwardly, the head of the drawing member 4 disconnects with the center hole portion of the diaphragm 3 and air enter the chamber, whereby the skin is released because of the vanish of the negative pressure.

Figure 4:
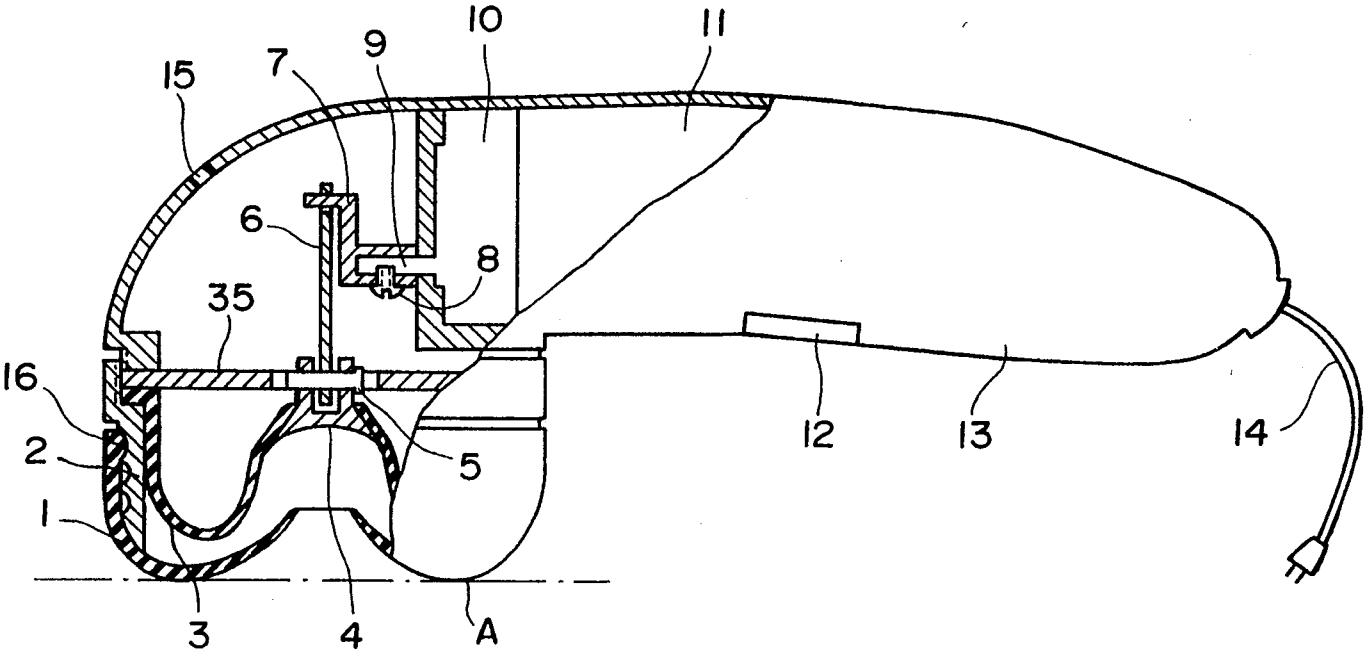
FIG. 4 is a partially sectional view of the fourth embodiment according to the invention, in which the center hole portion of the diaphragm is lifted at its highest position and in which the sucking lip contacts the skin with its more radially outward section.

During the upward movement of the drawing member 4, with the increase of the negative pressure the sucking lip 1 is longitudinally compressed to deform. The center hole portion of the sucking lip 1 is moved upwardly (as generally shown in FIG. 4), and the sucking lip 1 contacts with the skin A with its more radially outward section. Although further lift of the diaphragm 3 leads to an expanded negative pressure chamber, the volume of the negative pressure chamber would not be expanded at a great speed because of the longitudinal deformation of the sucking lip 1 resulted from the air pressure difference between the outer and inner sides of the contact section. Therefore, the change of the negative pressure is smooth and such smooth change brings about a comfortable feeling of suck. Furthermore, the sucking lip 1 is deformed along the skin surface, rather than relatively slides on the skin A, and therefore would not damage the skin.

Figure 2:
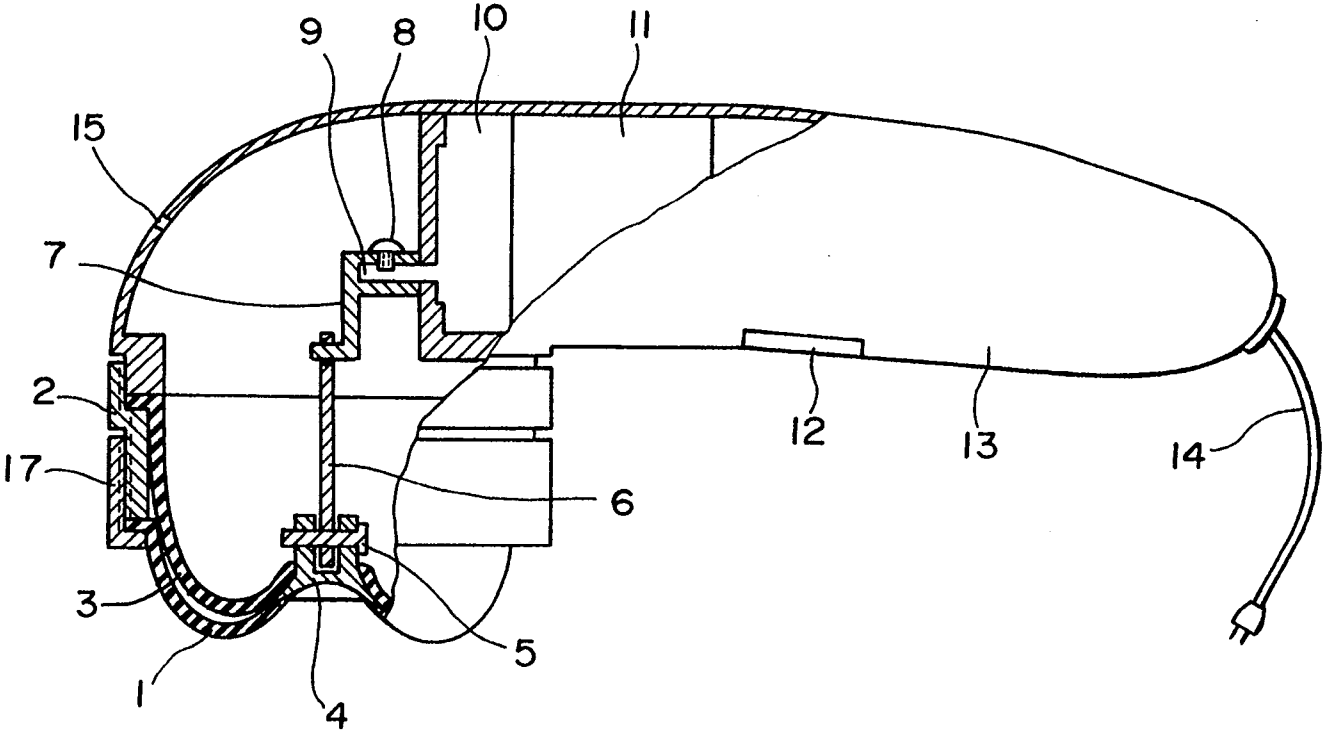
FIG. 2 is a partially sectional view of the second embodiment according to the invention.

FIG. 2 shows the second embodiment of the present invention. The differences between this embodiment and the first one are in that there is thread, rather than the grooves, formed in the outer wall of the lower part of the snapping member 2; a threaded sleeve 17 with inner thread fits with the lower part of the snapping member 2 to fix the flange at the open end of the sucking lip 1; and the motor and the electrical source used in the case 13 are DC motor and recharged battery connected by the adjustable-speed switch 12.

Figure 3:
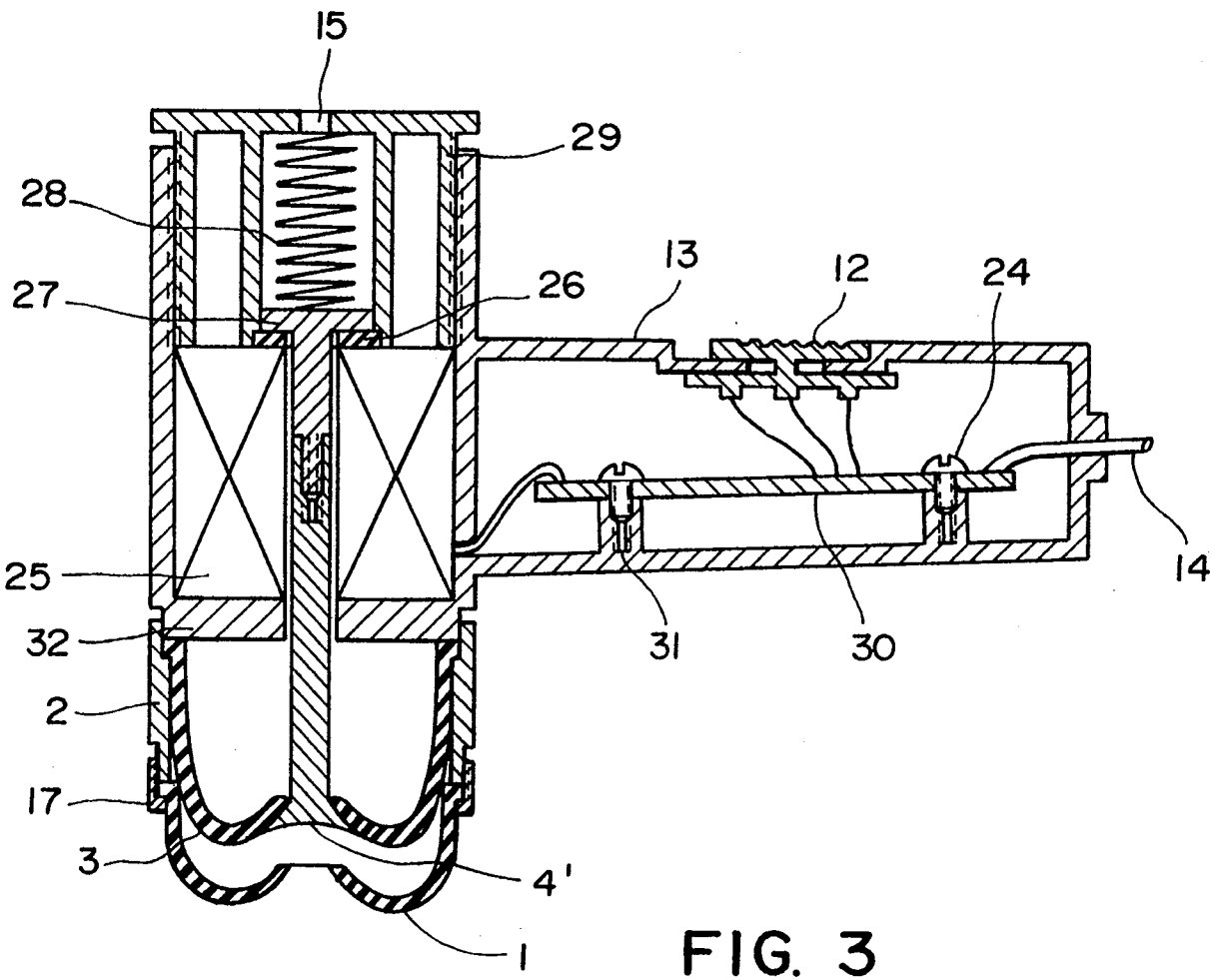
FIG. 3 is a partially sectional view of the third embodiment according to the invention.
Figure 5:
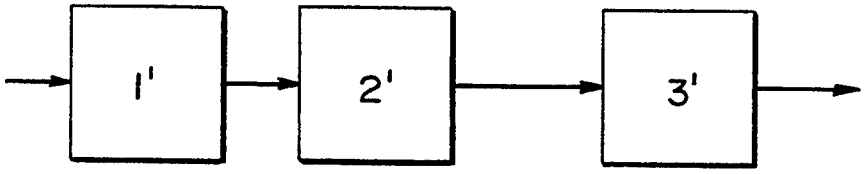
FIG. 5 is a block diagram of the circuit of the fourth embodiment according to the invention.

FIG. 3 shows the third embodiment of the present invention. The differences between this embodiment and the second one are in that the driving controller includes an electromagnetic coil 25, an armature 4', a limiting member 27, a spring 28, a buffer member 26, a casing cover 29 and a controlling printed board 30 with the switch 12. The casing cover 29 is provided with two cylinders concentrically and integrally formed. At the center of the enclosed end of the cover 29 is formed an air orifice 15 for flow of air. The cover 29 has a threaded outer wall which fits with the inner wall of the case 13. The electromagnetic coil 25 is arranged on the inner projections 32 and the casing cover 29 fitted in the case 13 compresses tightly the coil 25 in position. The spring 28 and the limiting member 27 is arranged in serial in the inner cylinder of the cover 29. The buffer member 26 is arranged between the coil 25 and a circular shoulder formed at the lower portion of the inner cylinder of the cover 29. The limiting member 27 is threaded with the armature 4', and the combination of them extends through the buffer member 26 and in the coil 25. The electric power wire 14 is electrically connected with the printed board 30 and the coil 25 through the switch 12. The printed board 30 is bolted on the projections 31 by the screws 24. As shown in FIG. 5, a voltage-stabilizing source 1', an oscillation circuit 2' and a driving circuit 3' are welded on the printing board 30.

The coil 25 is actuated by the pulsed voltage coming from the controlling printed board 30. The switch 12 is used to change the frequency of the pulsed voltage to adjust the value of sucking force and sucking frequency. When the coil 25 is on power, the armature 4' is lifted against the spring 28 and the center hole portion of the diaphragm 3 is deformed to produce the suck. When the coil 25 is off power, the armature 4' move downwardly under the action of biased spring 28 and air enters the negative pressure chamber. The sucking force may be adjusted within a certain range by means of changing the length of threaded portions of member 27 and the armature 4'.

Figure 7:
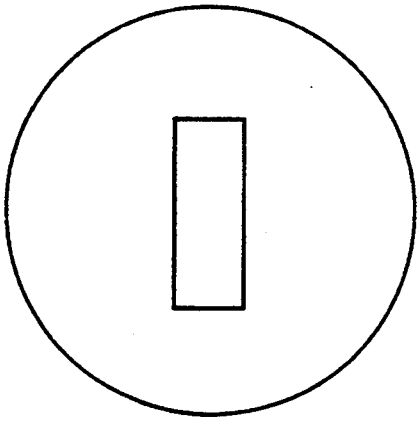
FIG. 7 is a top view of the electrically heated plate.

FIG. 4 is the fourth embodiment of the present invention and the differences between this embodiment and the first one are in that an electrically heated plate 35 is provided above the diaphragm 3 in the case. The plate 35 is electrically heated to bring out a comfortable contact of the sucking lip 1 with the skin. The plate 35 is shown in FIG. 7 as a circle one with a rectangular hole at its center for crossing of the elongated rod 6. Of course, an infrared ray heater may be provided in the case 13 to replace the electrically heated plate 35.

Figure 8:
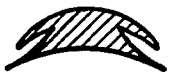
FIG. 8 is a sectional view of the medicament storing member used in the fifth embodiment according to the invention.

The fifth embodiment of the present invention is similar to the above embodiment and the difference between them is in that a medicament storing member made of sponge as shown in FIG. 8 is adhered on the concave bottom of the drawing member 4, or is detachably attached in the concave bottom of the drawing member 4. The medicament filled in the storing member is that used for hygienic purposes or treating purposes.

Figure 6:
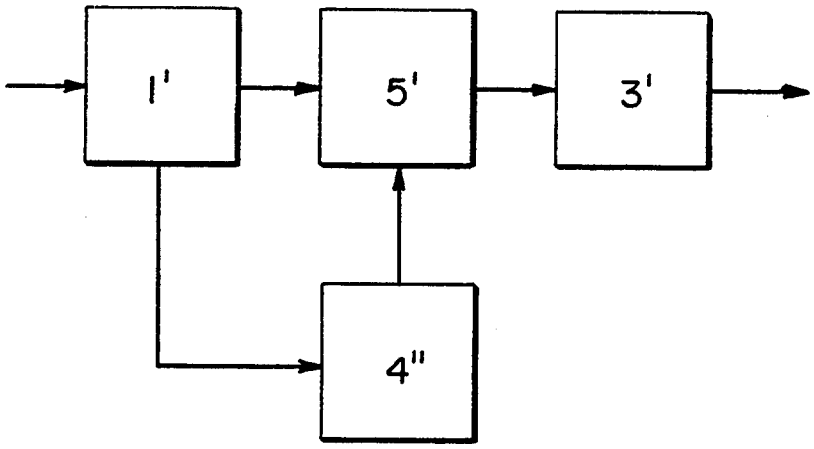
FIG. 6 is a block diagram of the circuit of the sixth embodiment.

The sixth embodiment of the present invention is similar to the third one and the differences between them are in that a heart pule sensor 4'' (FIG. 6) is provided to sense the heartbeat and outputs electric signals with the same frequency as that of heartbeat. The pulsed electric signals are changed by a monostable circuit 5' to monostable signals which are used to actuate the driving circuit 3' so that a suck is produced in the same frequency as that of the heartbeat.

While the description of the invention has been given with respect to a preferred embodiment, it is not to be constructed in a limited sense. Variation and modification will occur to those skilled in the art. Reference is made to the appended claims for a definition of the invention.

What is claimed is:

1. A sucking massage device for beauty skin treatment comprising:

a housing having a central axis and an open end;

inner and outer symmetrical and superimposed sucking lips disposed along the central axis, each of said sucking lips having a substantially annular shape and an outer annular edge coupled to said housing about said open end and an inner annular edge disposed inwardly from said outer edge and being substantially concentric with said outer edge and the central axis, wherein a cross-section of each of said lips have a substantially hook shape;

driving means coupled to said inner annular edge of said inner lip for axially reciprocating said inner lip to produce a suction.

2. The sucking massage device for beauty treatment according to claim 1, wherein said sucking lips are made of soft, elastic material.

3. The sucking massage device for beauty treatment according to claim 2, wherein said soft, elastic material is rubber.

4. The sucking massage device for beauty treatment according to claim 2, wherein said soft, elastic material is a soft, elastic synthetic material.

5. The sucking massage device of claim 1, said inner and other sucking lips being spaced apart in a rest position.

6. The sucking massage device of claim 1, wherein said housing comprises a collar having axial adjustment means, and said outer edge of said outer sucking lip being adjustably coupled to said collar and said adjustment means to adjust the position of said outer edge axially on said collar.

7. The sucking massage device of claim 6, wherein said adjustment means comprises a plurality of annular ribs on said collar.

8. The sucking massage device of claim 6, wherein said adjustment means comprises a threaded sleeve coupled to said collar for clamping said outer edge of said outer sucking lip to said collar.

9. The sucking massage device of claim 1, said driving means further comprising a coupling member coupled to said inner edge of said inner sucking lip, said coupling member having an outwardly facing concave surface positioned axially with respect to the inner edge of said outer sucking lip.

10. The sucking massage device of claim 9, further comprising an absorbent sponge containing a medicament removably coupled to said concave surface of said coupling member for dispensing said medicament to a user.

11. The sucking massage device of claim 1, further comprising heating means positioned in said housing for heating said sucking lips.

12. The sucking massage device of claim 11, wherein said heating means comprises a heating plate disposed in said housing and having a central aperture, and said drive means extending through said central aperture.

13. The sucking massage device of claim 1, wherein said drive means comprises a rotating motor means;

a crank arm coupled to said motor means; and a connecting arm connecting said crank arm to said inner sucking lip for reciprocating said inner lip.

14. The sucking massage device of claim 1, wherein said inner edge of said inner sucking lip is coupled to said driving means to substantially close said inner lip, and said inner edge of said outer sucking lip defines a suction opening.

15. The sucking massage device of claim 1, wherein said driving means comprises an electromagnetic coil for reciprocating said inner lip;

an armature connecting said inner lip to said coil;

a limiting member for limiting linear movement of said armature;

a spring for biasing said armature;

a buffer member disposed between said coil and said armature;

an electrical printed circuit board connected to said coil;

a switch connected to said circuit board, and a casing cover for said housing.

* * * * *